US006727854B2

(12) United States Patent
Fang et al.

(10) Patent No.: US 6,727,854 B2
(45) Date of Patent: Apr. 27, 2004

(54) PLANAR INVERTED-F ANTENNA

(75) Inventors: Shyh-Tirng Fang, Tainan (TW); Shih-Huang Yeh, Douliou (TW); Kin-Lu Wong, Kaohsiung (TW)

(73) Assignee: Industrial Technology Research Institute, Taipei ( * ) Notice: Subject to any disclaimer, the term of this patent is extended or adjusted under 35 U.S.C. 154(b) by 0 days.

(21) Appl. No.: 10/183,543

(22) Filed: Jun. 28, 2002

(65) Prior Publication Data

US 2003/0112185 A1 Jun. 19, 2003

(30) Foreign Application Priority Data

Dec. 19, 2001 (TW) ..... 90131457 A

(51) Int. Cl.[7] ..... H01Q 1/38

(52) U.S. Cl. ..... 343/700 MS; 343/702; 343/767

(58) Field of Search ..... 343/700 MS, 702, 343/846, 895, 767, 770

(56) References Cited

U.S. PATENT DOCUMENTS 6,133,879 A * 10/2000 Grangeat et al. .... 343/700 MS
6,408,190 B1 * 6/2002 Ying ..... 343/700 MS
6,476,769 B1 * 11/2002 Lehtola ..... 343/702

* cited by examiner

*Primary Examiner*—Hoang V. Nguyen
(74) *Attorney, Agent, or Firm*—Rabin & Berdo, P.C.

(57) ABSTRACT

A planar inverted-F antenna with a first operating bandwidth and a second operating bandwidth comprises a ground surface, a radiating device, a shorting device, a dielectric material, and a feeding device. The dielectric material is for isolating the radiating device from the ground surface. The feeding device is for transmitting a microwave signal. The radiating device further includes a first radiating element, a second radiating element, and a third radiating element. The first operating bandwidth is formed by the first resonance mode of the first radiating element and the second radiating element. The second operating bandwidth is formed by the second resonance mode of the first radiating element and the second radiating element and the first resonance mode of the third radiating element.

36 Claims, 11 Drawing Sheets

PLANAR INVERTED-F ANTENNA

This application incorporates by reference of Taiwan application Serial No. 90131457, Filed Dec. 19, 2001.

BACKGROUND OF THE INVENTION

1. Field of the Invention

The invention relates in general to a planar antenna, and more particularly to a planar inverted-F antenna.

2. Description of the Related Art

As the technology progresses, it makes people's daily life much easier. In terms of the communication technology, it leads to communication between people almost without the limitation of distance and time. In the past, wired domestic telephones and public telephones were commonly used for communication. They are convenient to use, but they have the disadvantage of lacking mobility. Thus, real-time communicating with people would be impossible in some situations. For this reason, pagers are developed to supplement the requirements of mobile communication. Recently, mobile phones are used more frequently than the pagers. Users can immediately make and receive a call by mobile phones. Further, users can even connect to the Internet for browsing information, sending and receiving electronic mails through the use of wireless application protocol (WAP). With these versatile functions, mobile phones are consequently standard personal communication equipments. The key to the popularity of mobile phones depends on their compact sizes, innovative functions, and affordable costs. Strictly speaking, the technology of circuit manufacturing determines all of these conditions. If the technology of circuit manufacturing is mature, the mobile phones can be more compact. In addition, the compact mobile phones contribute to their popularity, resulting in mass production and hence lowering the production cost. In this way, how to develop more compact circuitry is an important subject for engineers and researchers in this industry.

As discussed above, in terms of the integrated circuit development, the current and future trend is towards miniaturization. Thus, wireless communication products are invariably towards this trend. Antennas, the key components of the circuitry of wireless communication products, have to be minimized. When the antenna is in resonance at a resonance frequency, there will be an EM wave excited corresponding to the resonance frequency. The operating length of the antenna is decided by the wavelength ($\lambda$) of the resonance frequency. The operating length of the conventional antenna used in the wireless communication products, such as the dipole antenna or the microstrip patch antenna, is one-half of the wavelength ($\lambda/2$) of the resonance frequency. In recent years, the planar inverted-F antenna (PIFA) structure has been developed. The operating length can be decreased to one-fourth of the wavelength ($\lambda/4$) of the resonance frequency when using the planar inverted-F antenna in the wireless communication products. Therefore, the size of the antenna can be decreased. Besides, the planar inverted-F antenna can be placed above the ground plane and embedded within the housing of the mobile phone. Therefore, the purpose of hiding the antenna for the mobile phone can be achieved.

Referring now to FIG. 1, it illustrates the structure of the planar inverted-F antenna 100. The planar inverted-F antenna includes a radiating device 110, a ground surface 130, a dielectric material 150, a shorting device 170, and a feeding device 190. The dielectric material 150 is set between the radiating device 110 and the ground surface 130 for isolating the radiating device 110 from the ground surface 130. In practice, the dielectric material 150 can be air, a polystyrene, a substrate, or the combination of the above-disclosed materials. The radiating device 110 is coupled to the ground surface 130 through the shorting device 170. The shorting device 170 can be a simple metallic pin or other devices. The feeding device 190 can be set on the ground surface 130 and coupled to radiating device 110 for transmitting microwave signals. The feeding device 190 can be a SMA connector or other devices. The radiating device 110 and the ground surface 130 can be made of metallic materials. The operating length of the planar inverted-F antenna can be as short as one-fourth of the wavelength ($\lambda/4$) of the resonance frequency. Therefore, when using the planar inverted-F antenna in the wireless communication products, the size of the antenna can be decreased.

The system of the common dual-frequency mobile phone is GSM 900 or GSM 1800 system. In other words, the resonance frequency of the antenna in most mobile phones is 900 MHz or 1800 MHz. Since the size of the mobile phone is getting smaller and smaller, the size of the antenna must be decreased without affecting the performance of the antenna. Basically, the structure of each inverted-F antenna is substantially the same, as shown in FIG. 1. The difference of each inverted-F antenna is the pattern of the radiating device. The resonance frequency of the planar inverted-F antenna is decided by the pattern of the radiating device. Therefore, the design of the pattern of the radiating device is very important.

Referring now to FIG. 2A, it illustrates the conventional pattern design of the radiating device of the dual-frequency planar inverted-F antenna. The radiating device 210A is coupled to the shorting device at the ground connecting point 271. The radiating device 210A is coupled to the feeding device at the feeding point 291. For simplicity, the ground connecting point 271 is represented by a square and the feeding point 291 is represented by a triangle in FIG. 2 and the following figures. In FIG. 2A, the radiating device 210A includes an L-shape slot. It is obvious that, when the radiating device 210A is excited, there are two different effective surface current paths (L1 and L2) on the radiating device 210A. As shown in FIG. 2A, the length of the effective surface current path (L1) is different from that of the effective surface current path (L2). The shorter current path (L1) makes the antenna have a higher resonance frequency such as 1800 MHz, and the longer current path (L2) makes the antenna have a lower resonance frequency such as 900 MHz. In this manner, the antenna can be operated at both 900 MHz and 1800 MHz, and can be used in the dual-frequency mobile phone. Referring now to FIG. 2B, it illustrates another conventional pattern design of the radiating device of the dual-frequency planar inverted-F antenna. The radiating device 210B includes a U-shaped slot. When the radiating device 210B is activated, there are also two different effective surface current paths (L1 and L2), and the length of the effective surface current path (L1) is different from that of the effective surface current path (L2). The shorter effective surface current path (L1) makes the antenna have a higher resonance frequency, and the longer effective surface current path (L2) makes the antenna have a lower resonance frequency.

Referring now to FIG. 3A, it illustrates the diagram of the return loss of the conventional planar inverted-F antenna. The operating bandwidth of the antenna is defined to be 2.5:1 of the voltage standing wave ratio (VSWR). If the resonance frequency of the antenna is $f_0$, the ideal bandwidth of the antenna is BW1, as shown by the real line in FIG. 3A. However, in order to decrease the size of the antenna, the radiating device is set near the ground surface in the practical design. In this manner, the bandwidth of the antenna is narrowed. The practical bandwidth of the antenna is shown by the dashed line in FIG. 3A. The practical bandwidth is narrower than the ideal bandwidth. To sum up, the purpose of decreasing the size of the antenna can be achieved through lowering the position of the radiating device. However, the bandwidth of the antenna is narrowed, when lowering the position of the radiating device to the ground surface.

When the L-shape (shown in FIG. 2A) or the U-shape slot (shown in FIG. 2B) is set on the radiating device, the planar inverted-F antenna can have two different resonance frequencies. ("New slot configuration for dual-band planar inverted-F antenna", Microwave Optical Technology Letters, vol. 28, no. 5, Mar. 5, 2001, pp. 293–298). However, the operating bandwidth of the antenna is usually too narrow to satisfy the bandwidth requirement of the GSM 900 and GSM 1800 systems at the same time if the radiating device includes an L-shape or U-shape slot. There are also some other conventional methods for designing the pattern of the radiating device of the planar inverted-F antenna such as feeding capacitively as disclosed in U.S. Pat. No. 5,764,190. However, the structure of the antenna is too complicated and the cost of manufacturing is too high when using the above-disclosed method to design the antenna structure.

SUMMARY OF THE INVENTION

It is therefore an object of the invention to provide an improved and simplified planar inverted-F antenna with the following advantages. First, the operating bandwidth of the antenna is broad. Second, the size of the antenna can be decreased. Third, the structure of the antenna can be simplified.

The invention achieves the above-identified objects by providing a planar inverted-F antenna (PIFA) with a first operating bandwidth and a second operating bandwidth. The planar inverted-F antenna includes a ground surface, a radiating device, a shorting device, a dielectric material, and a feeding device. The dielectric material is set between the radiating device and the ground surface for isolating the radiating device from the ground surface. The feeding device is set on the ground surface and coupled to the radiating device for transmitting a microwave signal. The radiating device is coupled to the ground surface through the shorting device. The radiating device further includes a first radiating element, a second radiating element, and a third radiating element. The first radiating element has a first resonance mode and a second resonance mode. The second radiating element has a first resonance mode and a second resonance mode. The third radiating element has a first resonance mode. The first operating bandwidth of the planar inverted-F antenna is formed by the first resonance mode of the first radiating element and the first resonance mode of the second radiating element. The second operating bandwidth of the planar inverted-F antenna is formed by the second resonance mode of the first radiating element, the second resonance mode of the second radiating element, and the first resonance mode of the third radiating element.

BRIEF DESCRIPTION OF THE DRAWINGS

Other objects, features, and advantages of the invention will become apparent from the following detailed description of the preferred but non-limiting embodiments. The description is made with reference to the accompanying drawings, in which.

DETAILED DESCRIPTION OF THE INVENTION

Figure 1:
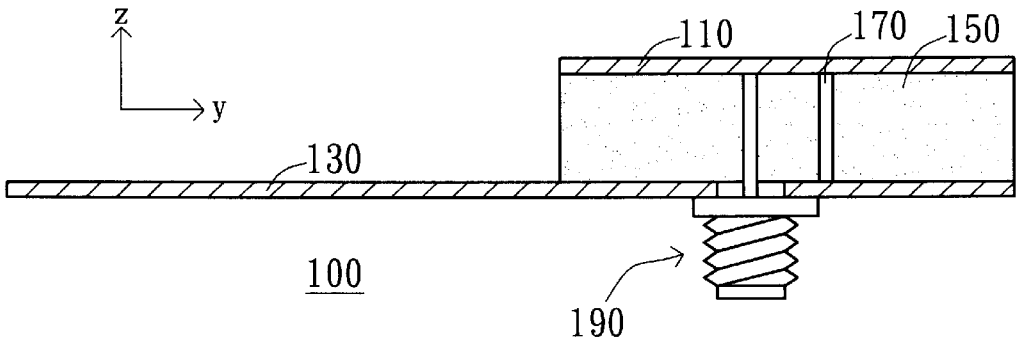
FIG. 1 (PRIOR ART)
FIG. 1 illustrates the structure of the planar inverted-F antenna.
Figure 2A:
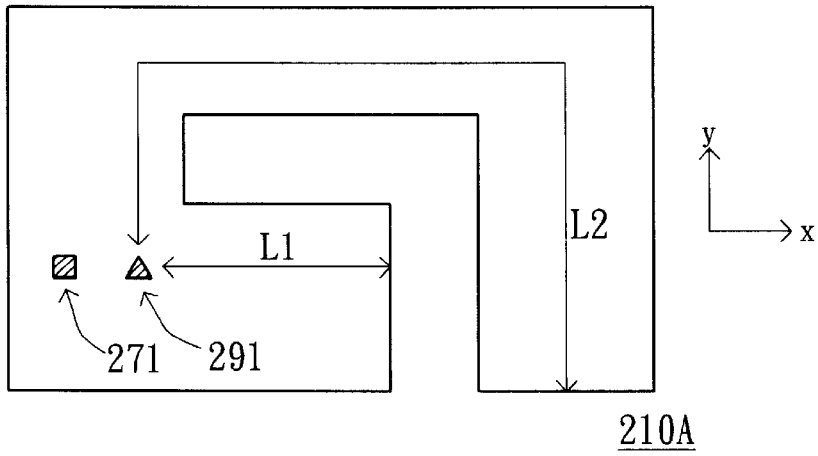
FIG. 2A (PRIOR ART)
FIG. 2A illustrates the conventional pattern design of the radiating device of the dual-frequency planar inverted-F antenna.
Figure 2B:
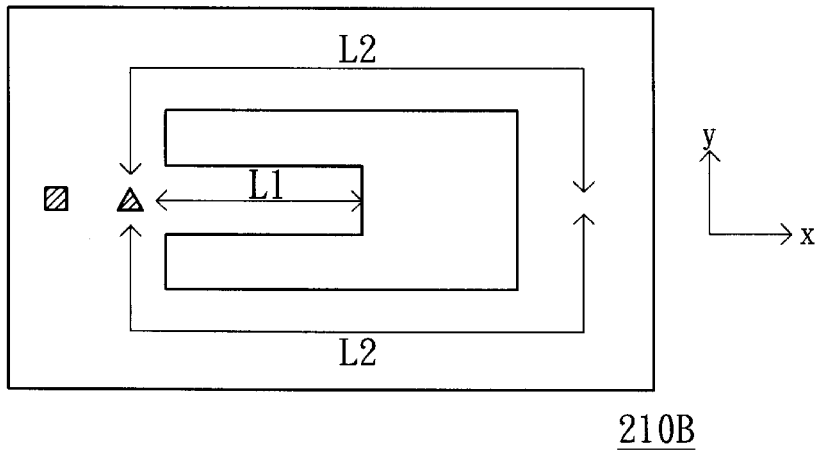
FIG. 2B (PRIOR ART)
FIG. 2B illustrates another conventional pattern design of the radiating device of the dual-frequency planar inverted-F antenna.
Figure 3A:
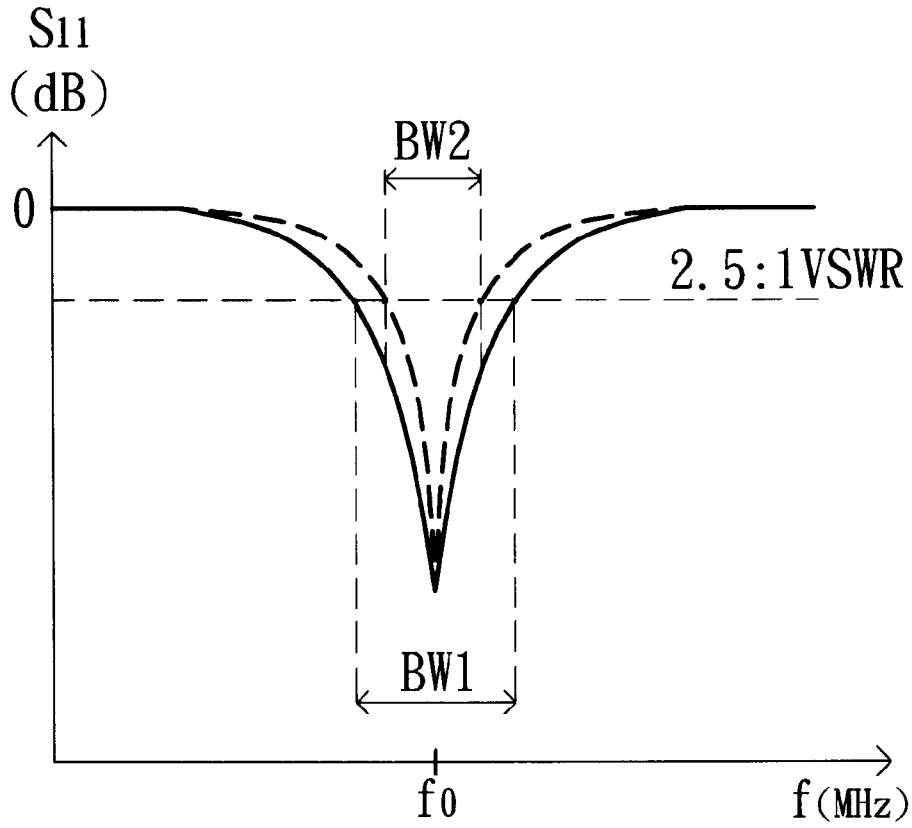
FIG. 3A (PRIOR ART)
FIG. 3A illustrates the diagram of the return loss of the conventional planar inverted-F antenna.
Figure 3B:
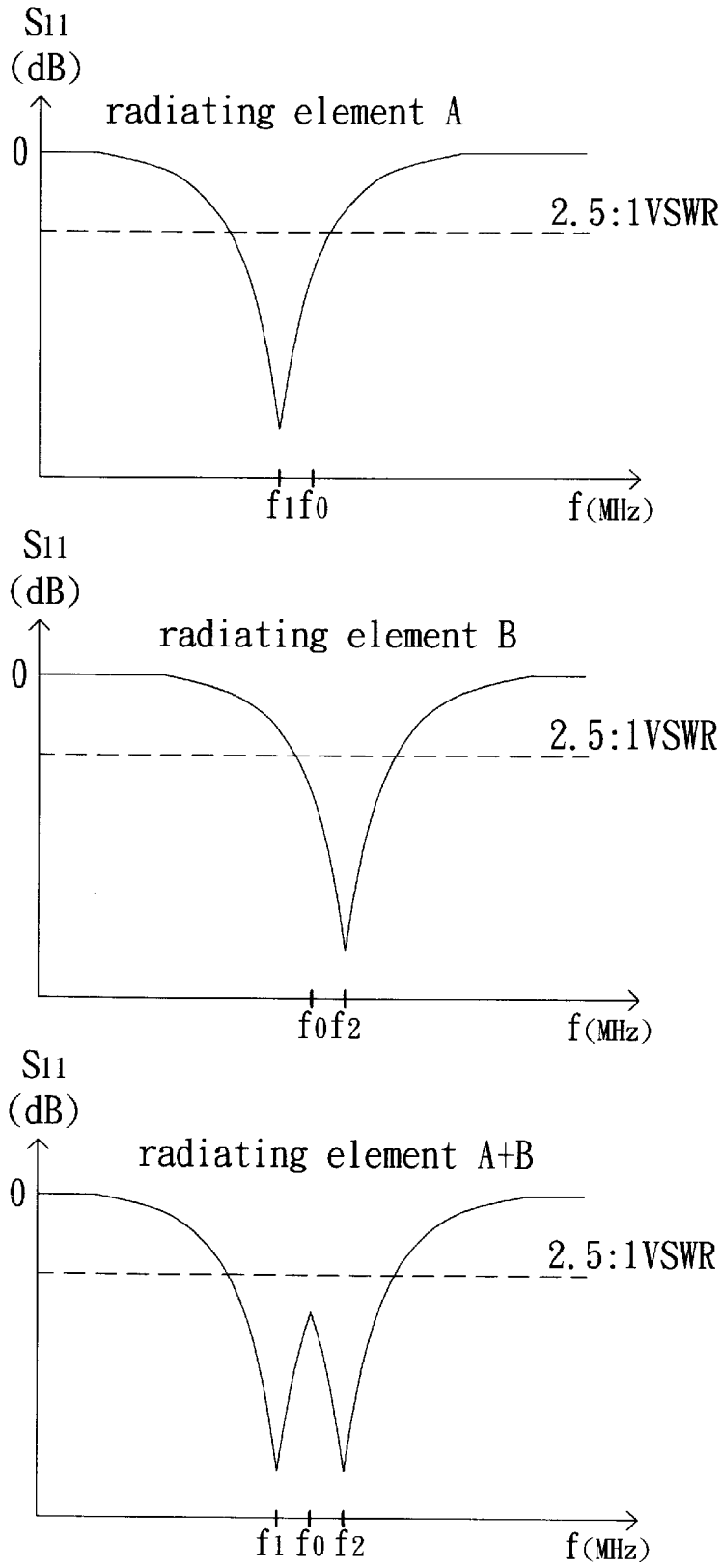
FIG. 3B illustrates the diagram of the return loss of the antenna which the radiating device includes two radiating elements.
Figure 3C:
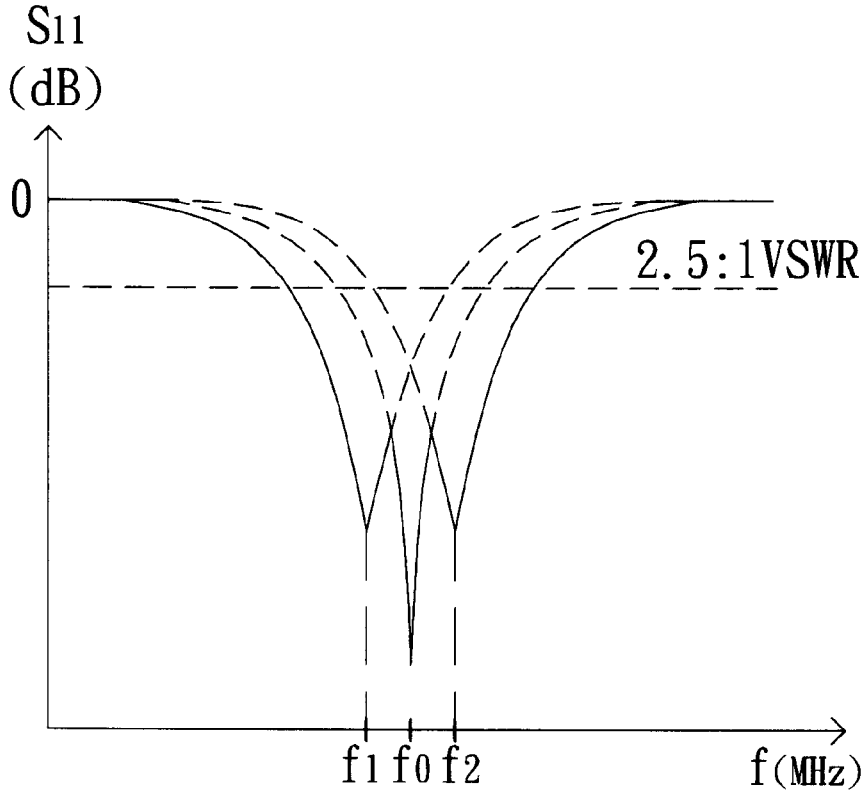
FIG. 3C illustrates the diagram of the return loss of the antenna which the radiating device includes three radiating elements.

Referring now to FIG. 3B, it illustrates the diagram of the return loss of the antenna whose radiating device includes two radiating elements. The central frequency of the antenna is $f_0$. The central frequency of the radiating element A (not shown) $f_1$ is slightly lower than $f_0$. The central frequency of the radiating element B (not shown) $f_2$ is slightly higher than $f_0$. If the radiating device of the antenna includes the radiating element A and radiating element B, the operating bandwidth of the antenna can be formed by the bandwidth of the radiating element A and that of the radiating element B. The bandwidth of the radiating element A and that of the radiating element B are narrow individually. However, since $f_0$, $f_1$, and $f_2$ are very close, the bandwidth of the radiating element A and the radiating element B can be overlapped. Therefore, the operating bandwidth of the antenna can be broadened through overlapping the bandwidth of each radiating element respectively. Referring now to FIG. 3C, it illustrates the diagram of the return loss of the antenna whose radiating device includes three radiating elements. If the radiating device of the antenna includes three radiating elements and the bandwidth of each radiating element is very close, the operating bandwidth of the antenna can be further broadened through overlapping the bandwidth of each radiating element respectively, as shown in FIG. 3C.

Figure 4:
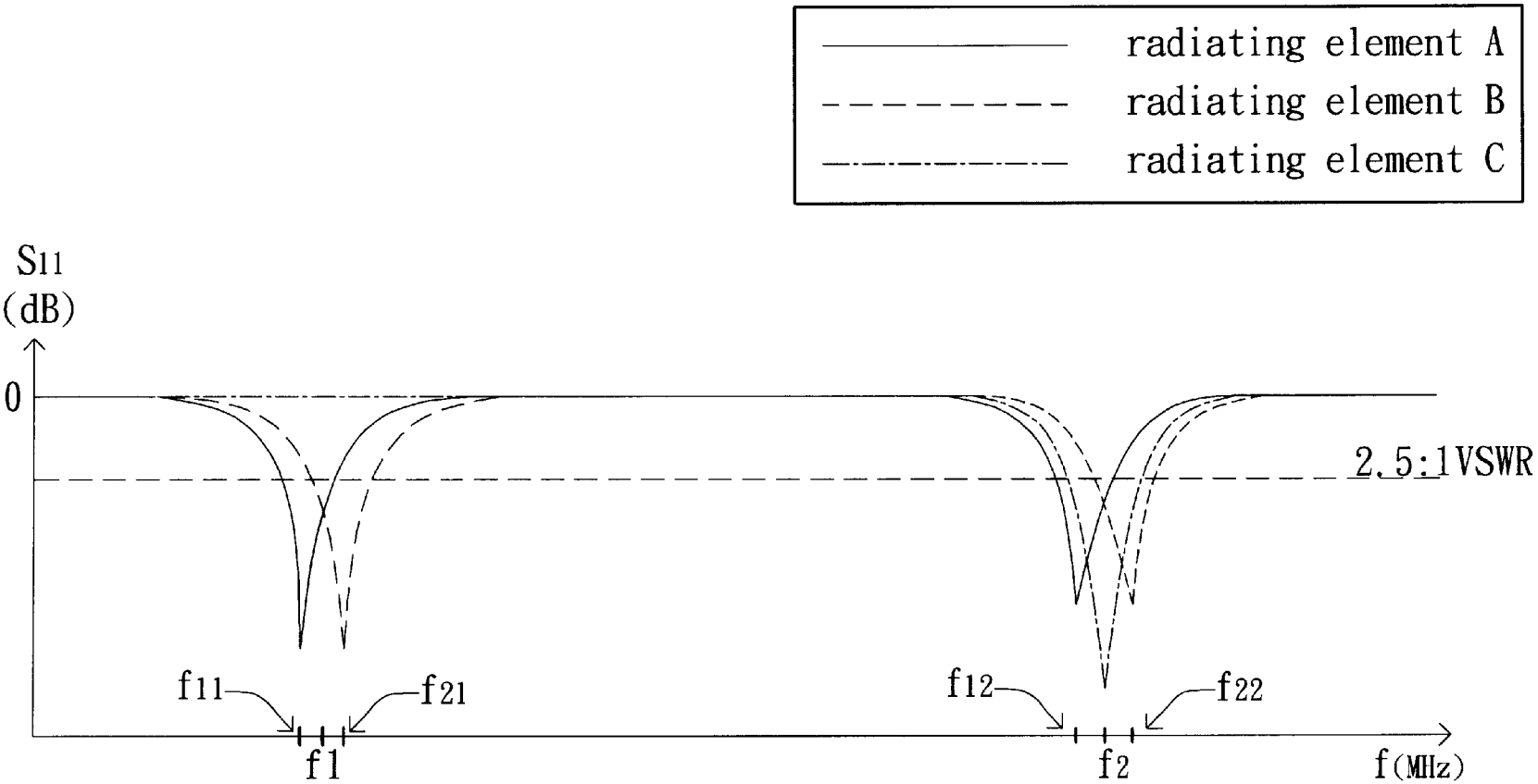
FIG. 4 illustrates the diagram of the return loss of the dual-frequency planar inverted-F antenna according to the embodiment of the present invention.

Referring now to FIG. 4, it illustrates the diagram of the return loss of the dual-frequency planar inverted-F antenna according to the embodiment of the present invention. The antenna of the present invention has two central frequencies $f_1$ and $f_2$. The radiating device of the antenna includes three radiating elements. The radiating element A has two resonance modes. The resonance frequency of the radiating element A is $f_{11}$ when the radiating element A is in the first resonance mode. The resonance frequency of the radiating element A is $f_{12}$ when the radiating element A is in the second resonance mode. The frequency $f_{11}$ is slightly lower than the frequency $f_1$ and the frequency $f_{12}$ is slightly lower than the frequency $f_2$. The return loss of the radiating element A is shown as a solid line in FIG. 4. The radiating element B also has two resonance modes. The resonance frequency of the radiating element B is $f_{21}$ when the radiating element B is in the first resonance mode. The resonance frequency of the radiating element B is $f_{22}$ when the radiating element B is in the second resonance mode. The frequency $f_{21}$ is slightly higher than the frequency $f_1$ and the frequency $f_{22}$ is slightly higher than the frequency $f_2$. The return loss of the radiating element B is shown as a dashed line in FIG. 4. The radiating element C has only one resonance mode. The resonance frequency of the radiating element C is $f_2$ when the radiating element C is in the first resonance mode. The return loss of the radiating element C is shown in FIG. 4. Each radiating element in the first resonance mode is in resonance in one-fourth of the wavelength ($\lambda/4$) of its resonance frequency, each radiating element in the second resonance mode is in resonance in one-half of the wavelength ($\lambda/2$) of its resonance frequency. Since 900 MHz is in the GSM band and 1800 MHz is in the DCS band, the antenna can be used in the GSM/DCS dual-frequency mobile phone if the central frequency $f_1$ is set to be 900 MHz and the second central frequency $f_2$ is set to be 1800 MHz.

Figure 5:
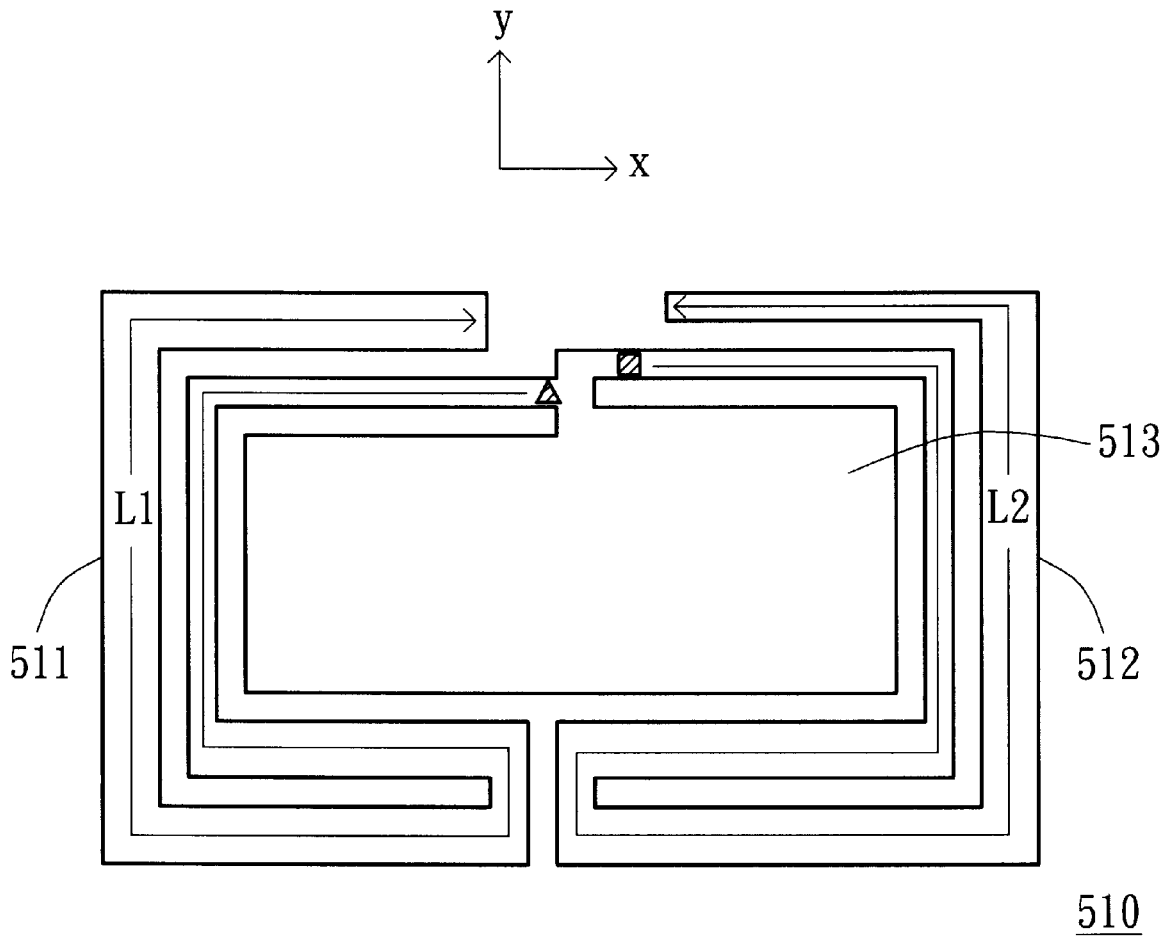
FIG. 5 illustrates the pattern of the radiating device of the planar inverted-F antenna according to the embodiment of the present invention.

Referring now to FIG. 5, it illustrates the pattern of the radiating device of the planar inverted-F antenna according to the embodiment of the present invention. The planar inverted-F antenna of the present invention includes a ground surface, a radiating device, a dielectric material, a shorting device, and a feeding device, as the same with the conventional planar inverted-F antenna. However, the pattern of the radiating device is different and that is crucial to the operating characteristics of the planar inverted-F antenna. As shown in FIG. 5, the radiating device of the present invention 510 includes three radiating elements. The first radiating element can be a meandered metallic strip 511, the second radiating element can be a meandered metallic strip 512, and the third radiating element can be a near-rectangular metallic patch 513. The metallic strips 511, 512, and the metallic patch 513 can be formed with integrity (in an integrated manner, i.e., in one body). In order to decrease the area of the radiating device 510, the metallic strip 511 is meandered around the left side of the metallic patch 513 and the metallic strip 512 is meandered around the right side of the metallic patch 513, as shown in FIG. 5.

The resonance frequency of the antenna used in the mobile phone should be in the GSM band (880~960 MHz) and the DCS band (1710~1880. Therefore, the resonance frequency of the metallic strip 511 set to be 900 MHz when the metallic strip 511 is in the first resonance mode. Besides, the resonance frequency of the metallic strip 512 is set to be 930 MHz when the metallic strip 512 is in the first resonance mode. The length of the surface current pathway L1 is set to be about one-fourth of the wavelength of the resonance frequency at 900 MHz and the length of the surface current pathway L2 is set to be about one-fourth of the wavelength of the resonance frequency at 930 MHz. The resonance frequencies of the metallic strip 511 and that of the metallic strip 512 are very close. The first operating bandwidth of the antenna can be formed (defined) by the first resonance mode of the metallic strip 511 and the metallic strip 512. Therefore, the first operating bandwidth of the antenna can be broadened through overlapping the bandwidth of the metallic strip 511 and that of the metallic strip 512. In this manner, the antenna can be in resonance in the GSM band (880~960 MHz).

The resonance frequency of the metallic strip 511 is set to be 1800 MHz when the metallic strip 511 is in the second resonance mode and the resonance frequency of the metallic strip 512 is set to be 1860 MHz when the metallic strip 512 is in the second resonance mode. Beside, the resonance frequency of the metallic patch 513 is set to be near 1800 MHz when the metallic patch 513 is in the first resonance mode. Each of the metallic strips 511 and 512 is in resonance in one-half of the wavelength of their respective resonance frequency. The metallic patch 513 is in resonance in one-fourth of the wavelength of the resonance frequency near 1800 MHz. The resonance frequency of the metallic strips 511, 512 in the second resonance mode and that of the metallic patch 513 in the first resonance mode are very close. The second operating bandwidth of the antenna can be formed by the second resonance mode of the metallic strip 511, the second resonance mode of the metallic strip 512, and the first resonance mode of the metallic patch 513. Therefore, the second operating bandwidth of the antenna can be broadened through overlapping the bandwidth of the metallic strips 511, 512 and that of the metallic patch 513. In this manner, the antenna can be in resonance in the DCS band (1710~1880 MHz).

Figure 6:
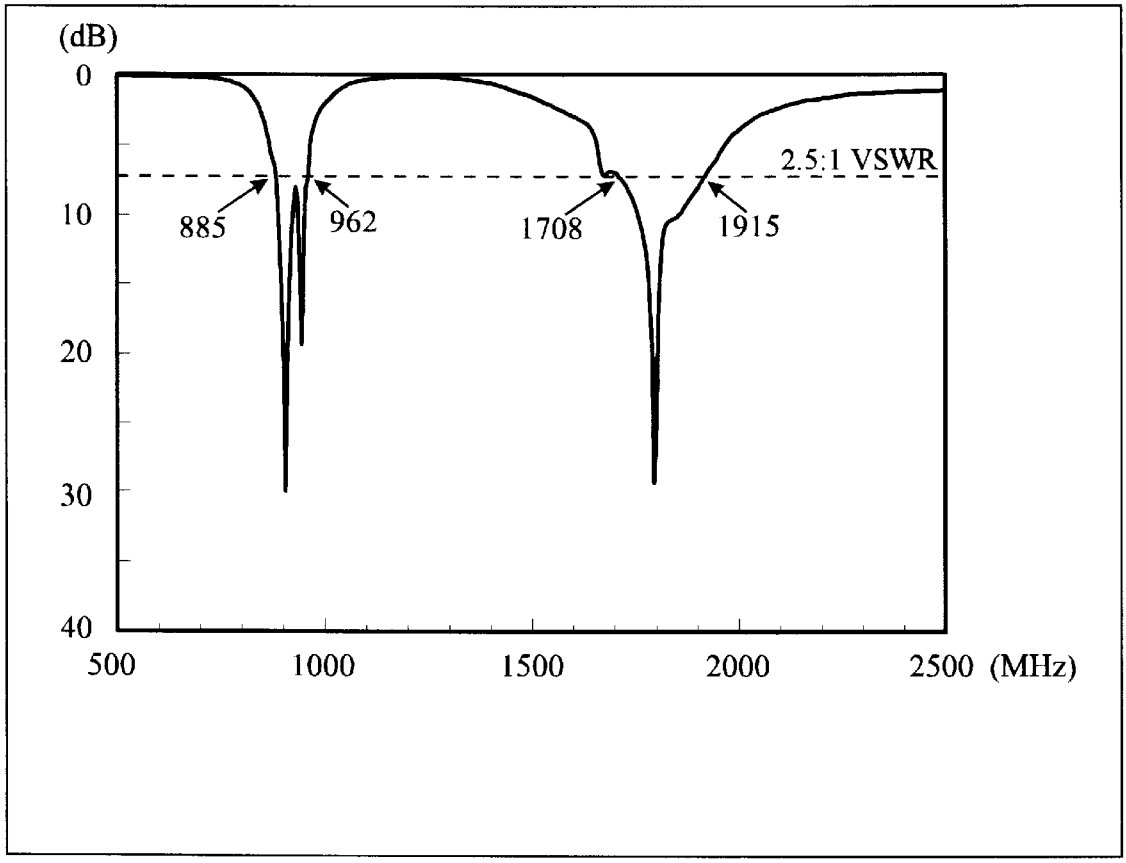
FIG. 6 illustrates the measured value of the return loss of the dual-frequency planar inverted-F antenna according to the embodiment of the present invention.

Referring now to FIG. 6, it illustrates the measured value of the return loss of the dual-frequency planar inverted-F antenna according to the embodiment of the present invention. The operating bandwidth of the antenna is defined to be 2.5:1 of the voltage standing wave ratio (VSWR). According to this definition, the first operating bandwidth of the antenna formed by the first resonance mode of the metallic strip 511 and that of the metallic strip 512 is 77 MHz (885~962 MHz). The second operating bandwidth of the antenna formed by the second resonance mode of the metallic strip 511, the second resonance mode of the metallic strip 512, and the first resonance mode of the metallic patch 513 is 207 MHz (1708~1915 MHz).

Figure 7A:
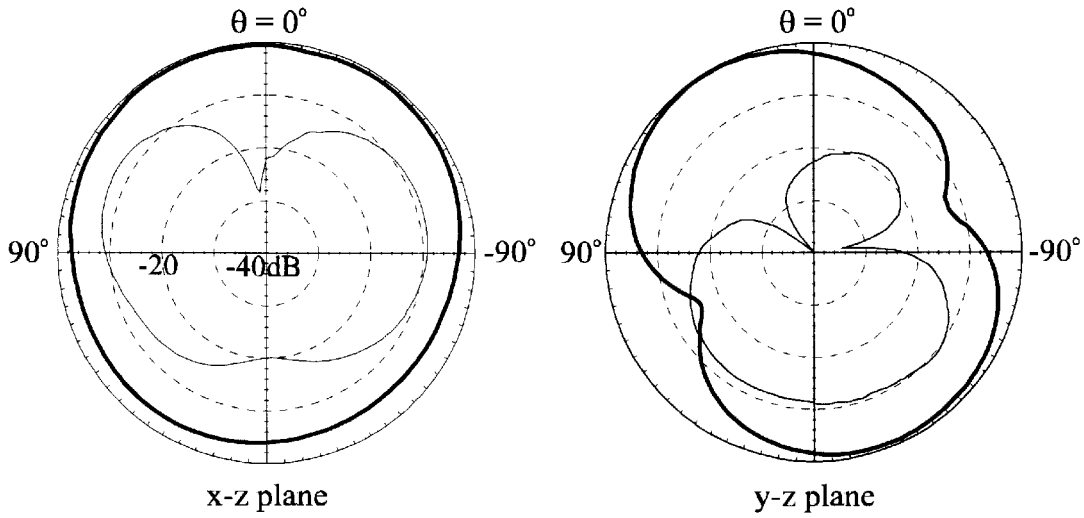
FIG. 7A illustrates the measured radiating pattern of the H-plane and E-plane when the antenna is operated at 925 MHz.
Figure 7B:
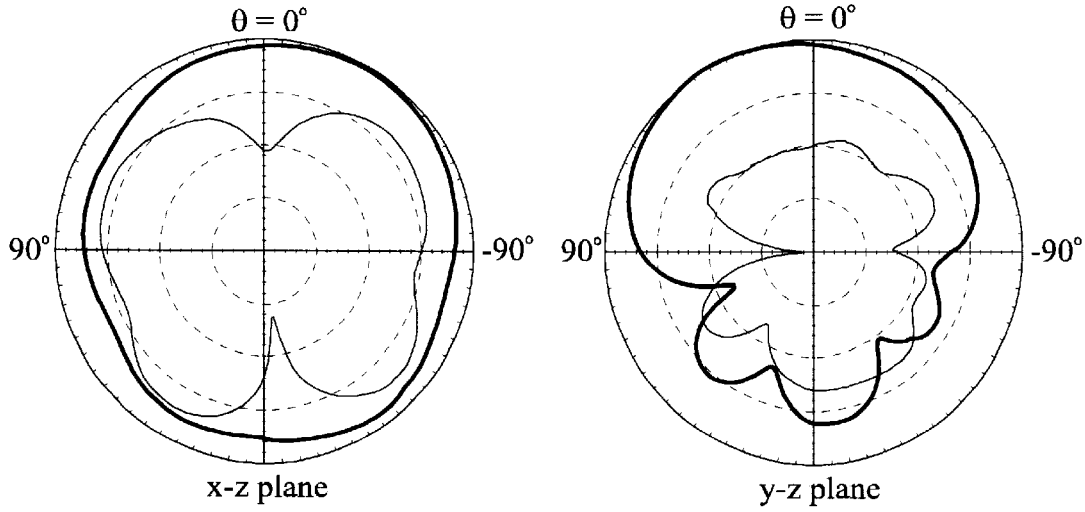
FIG. 7B illustrates the measured radiating pattern of the H-plane and E-plane when the antenna is operated at 1795 MHz.
Figure 8A:
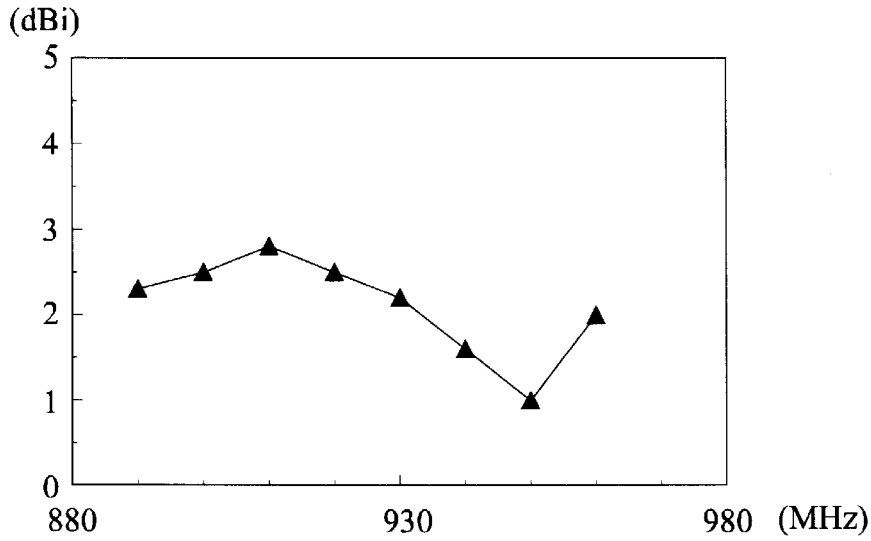
FIG. 8A illustrates the relation between the gain and the operating frequency of the antenna when operated in the GSM band.
Figure 8B:
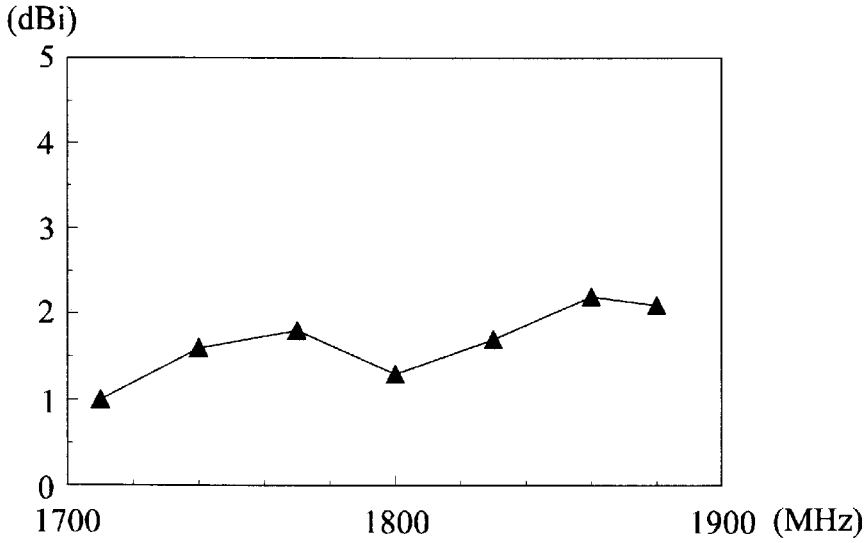
FIG. 8B illustrates the relation between the gain and the frequency of the antenna when operated in the DCS band.

Referring now to FIGS. 7A and 7B, FIG. 7A illustrates the measured radiating pattern of the H-plane and E-plane when the antenna is operated at 925 MHz and FIG. 7B illustrates the measured radiating pattern of the H-plane and E-plane when the antenna is operated at 1795 MHz. The principal polarization radiation pattern is represented by the thick line and the cross polarization radiation pattern is represented by the thin line, as shown in FIG. 7A and FIG. 7B. The H-plane is x-z plane and the E-plane is y-z plane. Referring now to FIGS. 8A and 8B, FIG. 8A illustrates the relation between the gain and the operating frequency of the antenna operated in the GSM band, and FIG. 8B illustrates the relation between the gain and the operating frequency of the antenna operated in the DCS band.

Figure 9A:
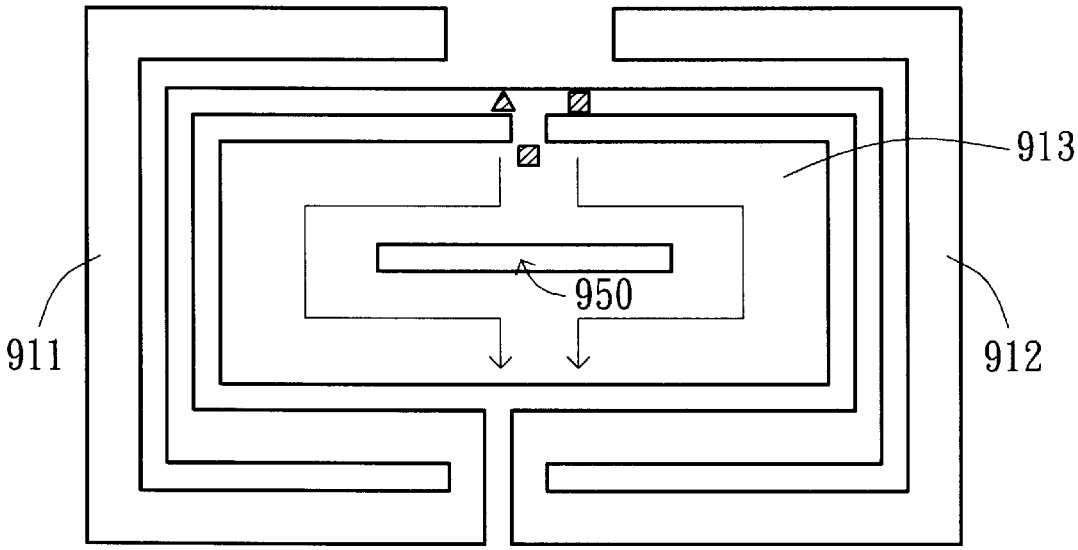
FIG. 9A illustrates the diagram of the metallic patch with a slot in the internal part of the metallic patch.
Figure 9B:
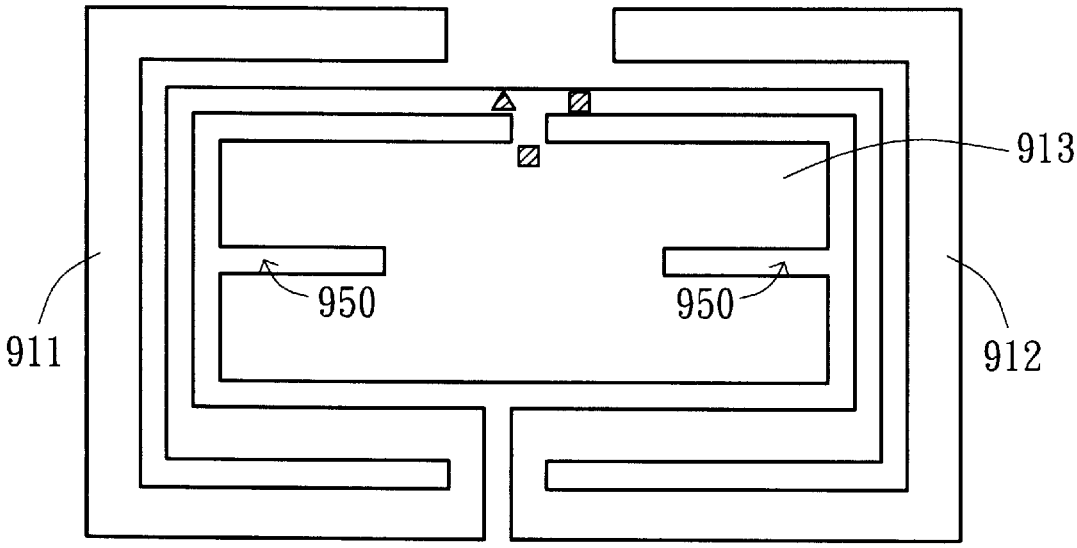
FIG. 9B illustrates the diagram of the metallic patch with a slot at the edge of the metallic patch.
Figure 9C:
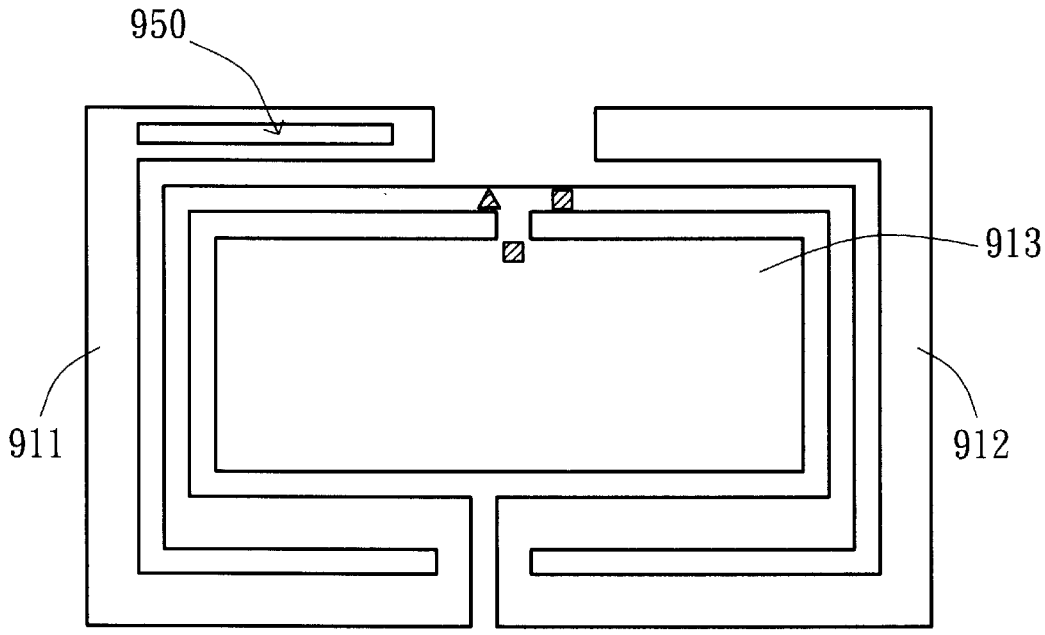
FIG. 9C illustrates the diagram of the metallic strip with a slot in the internal part of the metallic strip.
Figure 9D:
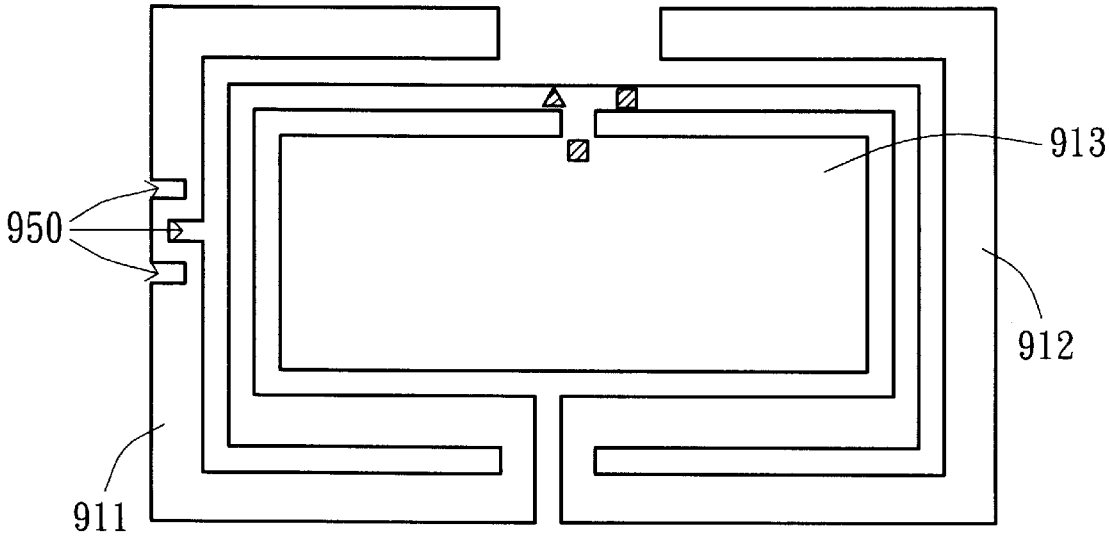
FIG. 9D illustrates the diagram of the metallic strip with a slot in the edge of the metallic strip.

The length of the surface current pathway can be changed through embedding a slot in the radiating element. Therefore, a slot can be embedded in the radiating element in order to decrease the size of the antenna. Referring now to FIGS. 9A and 9B, FIG. 9A illustrates the diagram of the metallic patch with a slot in the internal part of the metallic patch, and FIG. 9B illustrates the diagram of the metallic patch with a slot at the edge of the metallic patch. After the slot 950 is embedded in the metallic patch 913, the length of the surface current is increased. In this manner, the resonance frequency of the metallic patch 913 with the slot 950 is lower than that of the metallic patch 913 without the slot 950. In other words, if the resonance frequency is fixed, the size of the metallic patch 913 with the slot 950 can be smaller than that of the metallic patch 913 without the slot 950. Therefore, the size of the metallic patch can be further decreased through embedding the slot in the metallic patch. The slot can be embedded in the inner part of the metallic patch 913 (shown in FIG. 9A) or at the edge of the metallic patch 913 (shown in FIG. 9B). Referring now to FIGS. 9C and 9D, FIG. 9C illustrates the diagram of the metallic strip with a slot in the internal part of the metallic strip and FIG. 9D illustrates the diagram of the metallic strip with a slot at the edge of the metallic strip. In FIG. 9C, a slot 950 is embedded in the internal part of the metallic strip 911. Similarly, a slot, such as the slot 950 shown in FIG. 9C, can be embedded in an internal part of the metallic strip 912. In FIG. 9D, a slot 950 is embedded in the edge of the metallic strip 911. Similarly, a slot, such as the slot 950 shown in FIG. 9D, can be embedded in the edge of the metallic strip 912. In the same manner, the slot can be embedded in the inner part of the metallic strips 511, and 512 or at the edge of the metallic strips 511, and 512 to decrease the size of the metallic strips 511, and 512.

It should be noticed that the metallic strip and metallic patch are used as the radiating elements in the preferred embodiment of the present invention. However, the shape and the material of the radiating elements are not restricted to the metallic strip and the metallic patch disclosed in the preferred embodiment of the present invention.

The planar inverted-F antenna of the present invention includes three radiating elements. The resonance frequency of each radiating element is slightly different than that of the others. The operating bandwidth of the planar inverted-F antenna can be broadened through overlapping the bandwidth of each radiating element respectively. Therefore, the size of the planar inverted-F antenna can be decreased and the operating bandwidth of the antenna can be broadened. Besides, all radiating elements of the radiating device can be formed with integrity (in an integrated manner, i.e., in one body). Therefore, the structure of the radiating device can be simplified and the cost of manufacturing the radiating device can be decreased.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A planar inverted-F antenna (PIFA), wherein the planar inverted-F antenna has a first operating bandwidth and a second operating bandwidth, comprising:

a ground surface;

a shorting device;

a radiating device coupled to the ground surface through a the shorting device, comprising:

a first radiating element, wherein the first radiating element has a first resonance mode and a second resonance mode, and has a first effective length for providing a surface current pathway of the first radiating element;

a second radiating element, wherein the second radiating element has a first resonance mode and a second resonance mode, and has a second effective length for providing a surface current pathway of the second radiating element; and a third radiating element, coupled to the first and second radiating elements, wherein the third radiating element has a first resonance mode and has a second effective length for providing a surface current pathway of the third radiating element, the first and second effective lengths each being greater than two times the third effective length;

wherein the first operating bandwidth is defined by the first resonance mode of the first radiating element and the first resonance mode of the second radiating element and the second operating bandwidth is defined by the second resonance mode of the first radiating element, the second resonance mode of the second radiating element, and the first resonance mode of the third radiating element;

a dielectric material set between the radiating device and the ground surface for isolating the radiating device from the ground surface; and a feeding device set on the ground surface and coupled to the radiating device for transmitting a microwave signal.

2. The planar inverted-F antenna according to claim 1, wherein the first radiating element, the second radiating element and the third radiating element are integrated with each other.

3. The planar inverted-F antenna according to claim 1, wherein the first radiating element and the second radiating element are respective metallic strips and the third radiating element is a metallic patch.

4. The planar inverted-F antenna according to claim 3, wherein the metallic patch is rectangular.

5. The planar inverted-F antenna according to claim 3, wherein the first radiating element has a slot.

6. The planar inverted-F antenna according to claim 5, wherein the slot is embedded at an edge of the first radiating element.

7. The planar inverted-F antenna according to claim 5, wherein the slot is embedded in an internal part of the first radiating element.

8. The planar inverted-F antenna according to claim 3, wherein the first radiating element and the second radiating element is are set around the third radiating element.

9. The planar inverted-F antenna according to claim 3, wherein the second radiating element includes a slot.

10. The planar inverted-F antenna according to claim 9, wherein the slot is embedded at an edge of the second radiating element.

11. The planar inverted-F antenna according to claim 9, wherein the slot is embedded in an internal part of the second radiating element.

12. The planar inverted-F antenna according to claim 1, wherein the dielectric material includes the air.

13. The planar inverted-F antenna according to claim 1, wherein the dielectric material includes a substrate.

14. The planar inverted-F antenna according to claim 1, wherein the shorting device is a shorting metallic pin.

15. The planar inverted-F antenna according to claim 1, wherein the first operating bandwidth is within the GSM band and the second operating bandwidth is within the DCS band.

16. The planar inverted-F antenna according to claim 1, wherein the feeding device is a SMA connector.

17. The planar inverted-F antenna according to claim 1, wherein the third radiating element is a metallic patch including a slot.

18. The planar inverted-F antenna according to claim 17, wherein the slot is embedded at an edge of the metallic patch.

19. The planar inverted-F antenna according to claim 17, wherein the slot is embedded in the internal part of the metallic patch.

20. A planar inverted-F antenna (PIFA), wherein the planar inverted-F antenna has a first operating bandwidth and a second operating bandwidth, comprising:

a ground surface;

a radiating device coupled to the ground surface though a shorting metallic pin, comprising:

a metallic patch, wherein the metallic patch has a first resonance mode and a patch effective length for providing a surface current pathway of the metallic patch;

a first metallic strip, wherein the first metallic strip has a first resonance mode and a second resonance mode, and has a first effective length for providing a surface current pathway of the first metallic strip; and a second metallic strip, coupled to the first metallic strip and the metallic path, wherein the second metallic strip has a first resonance mode and a second resonance mode, and has a second effective length for providing a surface current pathway of the second metallic strip, the first and second effective lengths each being greater than two times the patch effective length;

wherein the first operating bandwidth is by the first resonance mode of the first metallic strip and the first resonance mode of the second metallic strip and the second operating bandwidth is defined by the second resonance mode of the first metallic strip, the second resonance mode of the second metallic strip, and the first resonance mode of the metallic patch;

a dielectric material set between the radiating device and the ground surface for isolating the radiating device from the ground surface; and a feeding device set on the ground surface and coupled to the radiating device for transmitting a microwave signal.

21. The planar inverted-F antenna according to claim 20, wherein the metallic patch, the first metallic strip, and the second metallic strip are formed integrated with each other.

22. The planar inverted-F antenna according to claim 20, wherein the first metallic strip includes a slot.

23. The planar inverted-F antenna according to claim 22, wherein the slot is embedded at the an edge of the first metallic strip.

24. The planar inverted-F antenna according to claim 22, wherein the slot is embedded in the internal part of the first metallic strip.

25. The planar inverted-F antenna according to claim 20, wherein the dielectric material includes the air.

26. The planar inverted-F antenna according to claim 20, wherein the dielectric material includes a substrate.

27. The planar inverted-F antenna according to claim 20, wherein the first operating bandwidth is within the GSM band and the second operating bandwidth is within the DCS band.

28. The planar inverted-F antenna according to claim 20, wherein the feeding device is a SMA connector.

29. The planar inverted-F antenna according to claim 20, wherein the metallic patch is rectangular.

30. The planar inverted-F antenna according to claim 20, wherein the metallic patch includes a slot.

31. The planar inverted-F antenna according to claim 30, wherein the slot is embedded at the an edge of the metallic patch.

32. The planar inverted-F antenna according to claim 30, wherein the slot is embedded in the internal part of the metallic patch.

33. The planar inverted-F antenna according to claim 20, wherein the second metallic strip includes a slot.

34. The planar inverted-F antenna according to claim 33, wherein the slot is embedded at an edge of the second metallic strip.

35. The planar inverted-F antenna according to claim 33, wherein the slot is embedded in the internal part of the second metallic strip.

36. A planar inverted-F antenna (PIFA), wherein the planar inverted-F antenna has a first operating bandwidth and a second operating bandwidth, comprising:

a ground surface;

a radiating device coupled to the ground surface through a shorting metallic pin, comprising:

a metallic patch, comprising a slot embedded in the internal part of the metallic patch, wherein the metallic patch has a first resonance mode;

a first metallic strip, wherein the first metallic strip has a first resonance mode and a second resonance mode; and a second metallic strip, wherein the second metallic strip has a first resonance mode and a second resonance mode;

wherein the first operating bandwidth is defined by the first resonance mode of the first metallic strip and the first resonance mode of the second metallic strip and the second operating bandwidth is defined by the second resonance mode of the first metallic strip, the second resonance mode of the second metallic strip, and the first resonance mode of the metallic patch;

a dielectric material set between the radiating device and the ground surface for isolating the radiating device from the ground surface; and a feeding device set on the ground surface and coupled to the radiating device for transmitting a microwave signal.

* * * * *

UNITED STATES PATENT AND TRADEMARK OFFICE

CERTIFICATE OF CORRECTION

PATENT NO. : 6,727,854 B2
APPLICATION NO. : 10/183543
DATED : April 27, 2004
INVENTOR(S) : Fang et al.

It is certified that error appears in the above-identified patent and that said Letters Patent is hereby corrected as shown below:

On the Title Page, Item (73) Assignee's residence:

"Industrial Technology Research Institute, Taipei" should be changed to -- Industrial Technology Research Institute, Hsinchu (TW) --

Signed and Sealed this
Twelfth Day of August, 2014

Michelle K. Lee

Michelle K. Lee
*Deputy Director of the United States Patent and Trademark Office*